US007425846B2

(12) United States Patent
Kim

(10) Patent No.: US 7,425,846 B2
(45) Date of Patent: Sep. 16, 2008

(54) GATE DRIVING DEVICE AND FLAT DISPLAY DEVICE EMPLOYING SUCH A GATE DRIVING DEVICE

(75) Inventor: Jun-Hyung Kim, Chunan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 20 days.

(21) Appl. No.: 11/502,495

(22) Filed: Aug. 11, 2006

(65) Prior Publication Data

US 2007/0035481 A1 Feb. 15, 2007

(30) Foreign Application Priority Data

Aug. 11, 2005 (KR) ..... 10-2005-0073771

(51) Int. Cl.
*H03K 19/094* (2006.01)
*H03K 19/0175* (2006.01)

(52) U.S. Cl. ..... 326/84; 326/82; 326/109; 345/68; 345/204

(58) Field of Classification Search ..... 326/64–65, 326/75–76, 84, 89, 109; 345/60–86
See application file for complete search history.

(56) References Cited

U.S. PATENT DOCUMENTS

| | | | | |
|---|---|---|---|---|
| 4,347,445 | A * | 8/1982 | Baker | 327/433 |
| 6,094,087 | A * | 7/2000 | He et al. | 327/434 |
| 6,400,344 | B1 | 6/2002 | Tsunoda et al. | |
| 6,680,834 | B2 * | 1/2004 | Williams | 361/58 |
| 6,801,065 | B2 * | 10/2004 | Hoshino et al. | 327/112 |
| 2005/0093782 | A1 * | 5/2005 | Lee | 345/68 |

FOREIGN PATENT DOCUMENTS

| | | | |
|---|---|---|---|
| KR | 10-0358454 | B1 | 10/2002 |
| KR | 10-0658639 | B1 | 12/2006 |

* cited by examiner

*Primary Examiner*—Anh Q Tran
(74) *Attorney, Agent, or Firm*—Lee & Morse, P.C.

(57) ABSTRACT

A flat display device may include a plurality of electrodes arranged in one direction, a first transistor coupled between the plurality of electrodes and a first power source for supplying a first voltage, and a gate driving circuit for supplying a driving voltage to a gate of the first transistor through a push-pull circuit including second and third transistors coupled between second and third power sources for respectively supplying second and third power sources, wherein a resistance formed between the second transistor and the second power source is greater than that formed between the third transistor and the third power source.

19 Claims, 5 Drawing Sheets

GATE DRIVING DEVICE AND FLAT DISPLAY DEVICE EMPLOYING SUCH A GATE DRIVING DEVICE

BACKGROUND OF THE INVENTION

1. Field of the Invention

The present invention relates to a gate driving device and a display device, e.g., a plasma display device, employing such a gate driving device. More particularly, the present invention relates to a driving circuit for driving a gate of a transistor employable in a display device.

2. Description of the Related Art

Various types of flat panel display devices, e.g., plasma display devices, are known. Plasma display devices are generally flat panel displays that employ plasma generated by a gas discharge process to display characters or images. A plasma display device may include a plurality of discharge cells arranged in a matrix pattern. Images may be displayed on a plasma display device when voltages are supplied to electrodes of a display panel of the plasma display device, and a discharge is generated.

More particularly, a plasma display device may be driven by applying various voltages to the electrodes of the plasma display device. A driving circuit for driving electrodes of the plasma display device may include a plurality of transistors for supplying the various voltages to the respective electrodes. Generally, periods during which respective power sources may supply voltages are short segments of time. Thus, a high level signal and a low level signal applied to a gate of a switch (MOSFET) should be quickly and exactly switched.

A gate driving circuit for supplying a signal to a gate of a switch may be formed in a push-pull manner in which NPN and PNP transistors may be complementarily coupled to each other.

However, when such a push-pull transistor formed with only NPN and PNP transistors is coupled to a gate as a switch, when a turn-on signal is input, a gate voltage may begin to increase before a turn-off signal is inputted, and the gate voltage thereof has completely fallen. Thus, the turn-on/off signals may be instantaneously overlapped.

The above information disclosed in this Background section is only for enhancement of understanding of the background of the invention, and therefore, it may contain information that does not form the prior art that is already known in this country to a person of ordinary skill in the art.

SUMMARY OF THE INVENTION

The present invention is therefore directed to gate driving devices and flat display devices employing a gate driving device, which substantially overcome one or more of the problems due to the limitations and disadvantages of the related art.

It is therefore a feature of an embodiment of the invention to provide a gate driving device including a gate driver capable of increasing a rising time period of a control signal with respect to a high level signal applied to a gate of a switch.

It is therefore a separate feature of an embodiment of the invention to provide a gate driving device including a gate driver capable of increasing a rising period of a control signal with respect to a high level signal applied to a gate of a switch.

It is therefore a separate feature of an embodiment of the invention to provide a plasma display device and gate driving device capable of slowing down a turn-on speed of a switch by coupling a resistor to a transistor of a push-pull circuit of a gate driving circuit.

At least one of the above and other features and advantages of the present invention may be realized by providing a flat display device including a plurality of electrodes arranged in one direction, a first transistor coupled between the plurality of electrodes and a first power source for supplying a first voltage, and a gate driving circuit for supplying a driving voltage to a gate of the first transistor through a push-pull circuit including second and third transistors coupled between second and third power sources for respectively supplying second and third power sources, wherein a resistance formed between the second transistor and the second power source is greater than that formed between the third transistor and the third power source.

One of the second and third transistors may be an NPN transistor and the other of the second and third transistors may be a PNP transistor. A first resistor may be provided between the second power source and a collector of the second transistor. A time for changing a voltage between the gate and a source of the first transistor from a fourth voltage corresponding to the third voltage to a fifth voltage corresponding to the second voltage in response to a turn-on of the second transistor may be longer than that for changing a voltage between the gate and source of the first transistor from the fifth voltage to the fourth voltage corresponding to the second voltage in response to a turn-on of the third transistor.

A control signal having a first voltage level or a second voltage level may be applied to bases of the second and third transistors, the second transistor may be turned on in response to a first voltage level of the control signal, and the third transistor may be turned on in response to a second voltage level of the control signal, the first voltage level may be different from the second voltage level, and emitters of the second and third transistors may be coupled to an output terminal of the push-pull circuit. The second transistor may be the NPN transistor, the third transistor may be the PNP transistor, and the first voltage level may be greater than the second voltage level.

A capacitor may be coupled between the output terminal of the push-pull circuit and the gate and source of the first transistor. The flat panel display device may include a second resistor coupled between the first power source and a first terminal of the capacitor, a third resistor coupled between a second terminal of the capacitor and the gate of the first transistor, a fourth resistor coupled between the second terminal of the capacitor and a source of the first transistor, and a zener diode coupled between the second terminal of the capacitor and the source of the first transistor.

The flat panel display device may include a capacitor having a first terminal for supplying the second voltage of the second power source and a second terminal for supplying the third voltage of the third power source, and charged with a voltage corresponding to a difference between the second and third voltages, the second terminal being coupled to the source of the first transistor. A diode may be coupled between the first terminal of the capacitor and the first resistor. A second resistor may be coupled between the gate of the first transistor and the output terminal of the push-pull circuit.

At least one of the above and other features and advantages of the present invention may be separately realized by providing a gate driving device for driving a gate of a driving transistor, the gate driving device including a first transistor having an emitter coupled to an output terminal of the gate driving device, a first resistor coupled between a first power source for supplying a first voltage and a collector of the first transistor, and a second transistor of a different conductive type from the first transistor, having an emitter coupled to the output terminal and a collector coupled to a second power source for supplying a second voltage, wherein a gate of the driving transistor is applied with a voltage corresponding to the voltage of the output terminal in response to a control signal applied to bases of the first and second transistors.

The control signal may have a first voltage level or a second voltage level, the first transistor may be turned on in response to the first voltage level, and the second transistor may be turned on in response to the second voltage level, the first voltage level may be different from the second voltage level. A capacitor may be coupled between the output terminal and the gate of the driving transistor. The gate driving apparatus may include a capacitor having a first terminal for supplying a first voltage of the first power source and a second terminal for supplying a second voltage of the second power source, and charged by a voltage corresponding to a difference between the first and second voltages, the second terminal being coupled to a source of the first transistor.

A resistance formed by the first resistor between the collector of the first transistor and the first power source may be greater than that formed between the collector of the first transistor and the second power source. The first transistor may be a NPN transistor and the second transistor may be a PNP transistor.

At least one of the above and other features and advantages of the present invention may be separately realized by providing a driving circuit for a flat panel display apparatus including a plurality of electrodes arranged in one direction, a first transistor coupled between the plurality of electrodes and a first power source for supplying a first voltage, the driving circuit for driving the first transistor, the driving circuit may include a push-pull circuit including second and third transistors coupled between second and third power sources for respectively supplying second and third power sources, and a delaying mechanism for delaying a start time for supplying a turn-on voltage signal for turning on the first transistor relative to a start time for supplying a turn-off signal for turning off the first transistor.

The delaying mechanism may include a resistance mechanism between at least one of the second transistor and the second power source and the third transistor and the third power source such that a resistance between the second transistor and the second power source may be greater than a resistance between the third transistor and the third power source. The second and third transistors may be coupled at an output terminal of the push-pull circuit, and the delaying mechanism may include a resistance mechanism between the output terminal of the push-pull circuit and the second transistor.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Korean Patent Application No. 10-2005-0073771 filed in the Korean Intellectual Property Office on Aug. 11, 2005, and entitled, "Plasma Display Device and Gate Driving Device," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

Throughout this specification and claims which follow, when it is described that an element is coupled to another element, the element may be directly coupled to the other element or electrically coupled to the other element through a third element. In addition, throughout this specification and claims which follow, unless explicitly described to the contrary, the word "comprise/include" or variations such as "comprises/includes" or "comprising/including" will be understood to imply the inclusion of stated elements but not the exclusion of any other elements.

An exemplary embodiment of a plasma display device and an exemplary embodiment of gate driving device employing one or more aspects of the invention will now be described.

Figure 1:
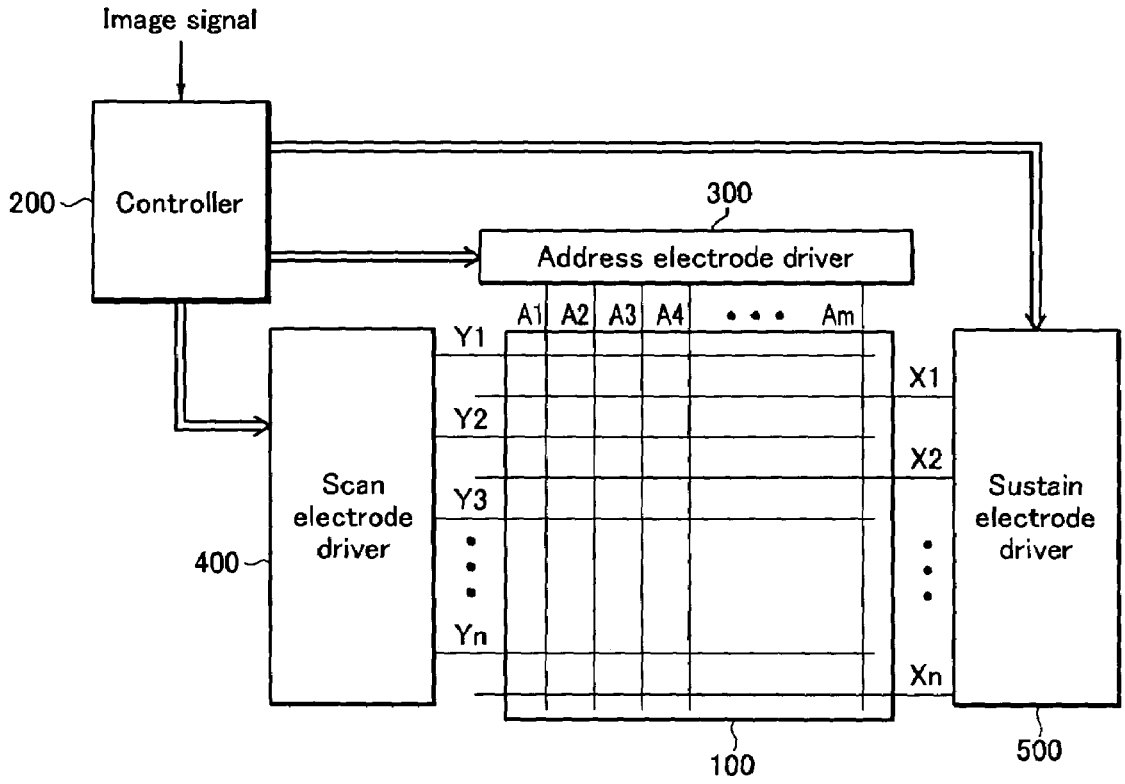
FIG. 1 illustrates a schematic view of an exemplary embodiment of a plasma display device employing one or more aspects of the present invention.

FIG. 1 illustrates a schematic view of an exemplary embodiment of a plasma display device employing one or more aspects of the present invention;

As illustrated in FIG. 1, a plasma display device may include a plasma display panel (PDP) 100, a controller 200, an address electrode driver 300, a scan electrode driver (X-electrode driver) 400, and sustain electrode driver (Y-electrode driver) 500.

The PDP 100 may include a plurality of address electrodes A1 to Am (hereinafter referred to as "A electrodes") extending, e.g., along a first direction, and a plurality of sustain and scan electrodes X1 to Xn and Y1-Yn (hereinafter respectively referred to as "X electrodes" and "Y electrodes") extending, e.g., in pairs along a second direction. The first direction may correspond to a column direction and the second direction may correspond to a row direction such that the A electrodes and the X and Y electrodes may cross each other. The first direction may be perpendicular to the second direction.

In the exemplary configuration of the PDP 100 illustrated in FIG. 1, discharge spaces may be defined at areas where the A electrodes A1 to Am cross the sustain and scan electrodes X1 to Xn and Y1 to Yn, thereby defining discharge cells. One or more aspects of the invention may be employed by display device(s) having configuration(s) other than the configuration illustrated in FIG. 1.

The controller 200 may output X, Y and A electrode driving control signals after receiving an image signal, e.g., externally supplied image signal. Each frame of the received image signal may include a plurality of subfields having respective weighted values. Each subfield may include a reset period, an address period and a sustain period. The controller 200 may sequentially output the X, Y and A driving signals associated with each subfield.

After receiving the A driving control signal from the controller 200, the address electrode driver 300 may apply display data signals, for selecting discharge cells to be displayed, to the respective A electrodes A1-Am.

The X electrode driver 400 may apply a driving voltage to the X electrodes X1-Xn after receiving the X electrode driving control signal from the controller 200. The Y electrode driver 500 may apply a driving voltage to the Y electrodes Y1-Yn after receiving the Y electrode driving control signal from the controller 200.

Figure 2:
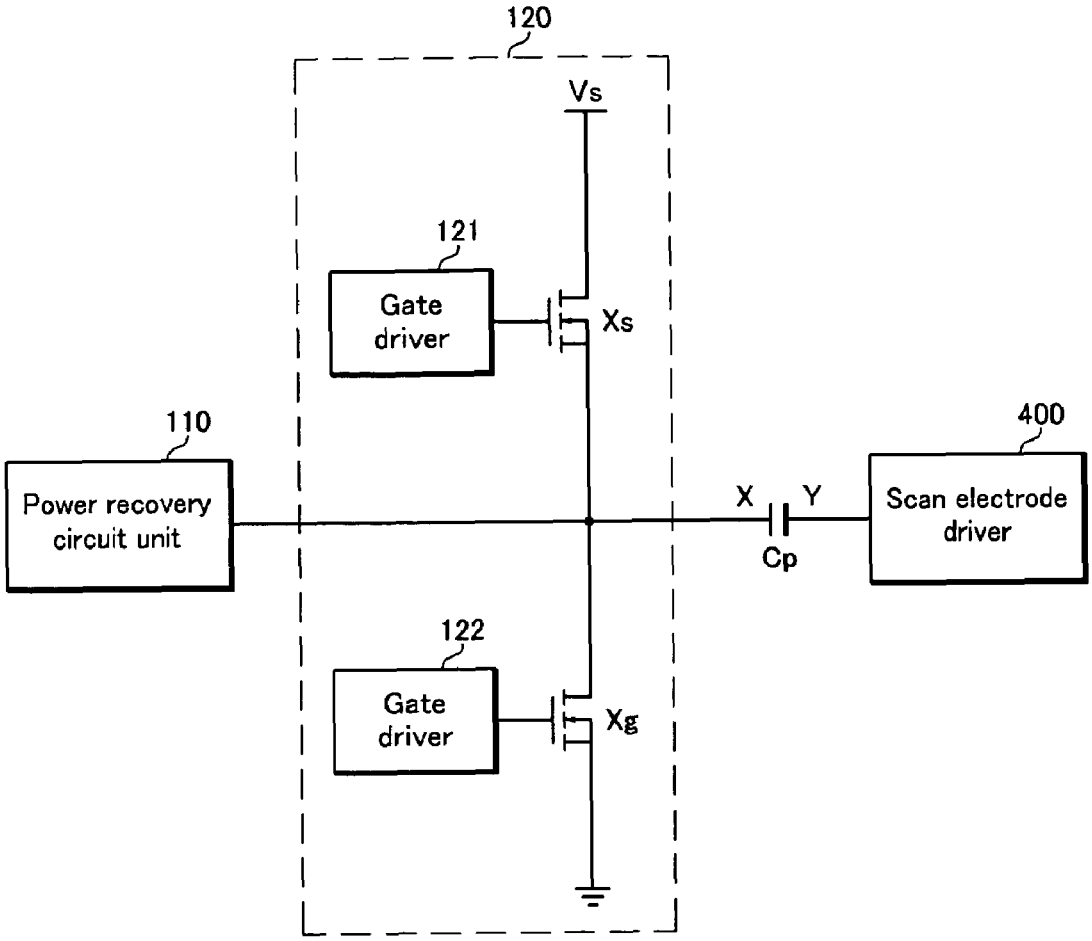
FIG. 2 illustrates a partial schematic view of an exemplary embodiment of a driving circuit of a display device employing one or more aspects of the present invention.

FIG. 2 illustrates a partial schematic view of an exemplary embodiment of driving circuit employable by a display device, e.g., a plasma display device.

A sustain discharge driving circuit may be used, as an exemplary driving circuit, in the following description of one or more aspects of the invention. A sustain discharge driving circuit may be formed, e.g., in the Y electrode driver 400 or the X electrode driver 500 of the exemplary plasma display device illustrated in FIG. 1.

FIG. 2 illustrates an exemplary sustain discharge driving circuit coupled to the X electrode, and a capacitive component formed by the X electrode and the Y electrode is denoted as a panel capacitor Cp. In the following description, an N-channel field effect transistor (FET) may be used as an exemplary transistor, but other types of transistors that perform the same or similar functions may be used in embodiments of the invention. In embodiments of the invention, a plurality of transistors coupled in parallel may be used as a transistor.

As illustrated in FIG. 2, the sustain discharge driving circuit may include a power recovery circuit unit 110 and a sustain voltage supply 120.

The power recovery circuit unit 110 may charge the panel capacitor Cp with a voltage Vs and/or may discharge the panel capacitor Cp with a ground voltage.

The sustain voltage supply 120 may be coupled to the X electrode(s) of the panel capacitor Cp and may include a plurality of transistors, e.g., two transistors Xs and Xg. The transistor Xs may be coupled between a power source for supplying a sustain discharge voltage Vs and the X electrode of the panel capacitor Cp. The transistor Xg may be coupled between a power source for supplying a ground voltage 0V and the X electrode of the panel capacitor Cp. The transistors Xs and Xg may respectively supply the voltage Vs and 0V to the X electrode of the panel capacitor Cp.

Gate drivers 121 and 122 may be respectively coupled to gates of the transistors Xs and Xg. A turn-on/turn-off state of the transistors Xs and Xg may be determined by a respective signal output from the gate drivers 121 and 122.

The gate drivers 121 and 122, which may be respectively coupled to the gates of the transistor Xs or Xg, will be described with reference to FIGS. 3 to 5. In embodiments of the invention, the gate driving circuits coupled to the gate of each transistor Xs and Xg may be the same. Thus, the exemplary embodiments of the gate driver 121, as coupled to the gate of the transistor Xs, and described below with reference to FIGS. 3 to 5 may also be employed as the gate driver 122 for driving the gate of the transistor Xg.

Figure 3:
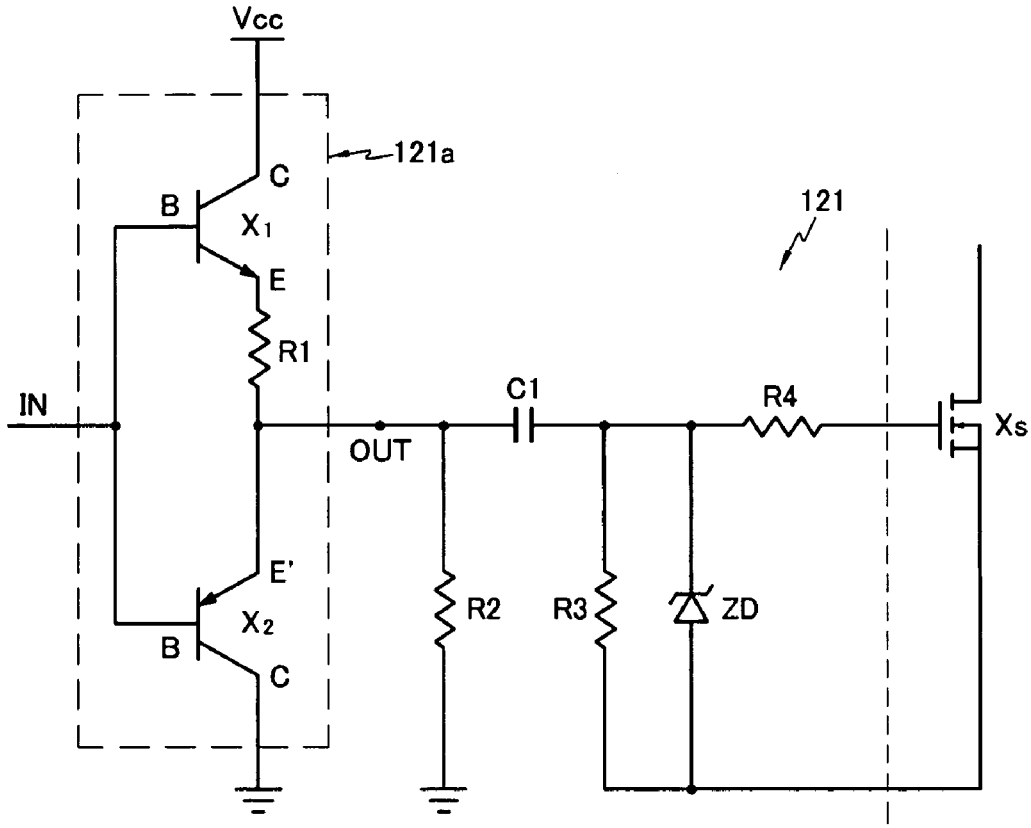
FIG. 3 illustrates a first exemplary embodiment of a gate driving circuit employing one or more aspects of the present invention.

FIG. 3 illustrates a first exemplary embodiment of a gate driving circuit employing one or more aspects of the present invention.

As illustrated in FIG. 3, the gate driver 121 may include a NPN transistor $X_1$, a PNP transistor $X_2$, a capacitor C1, a Zener diode ZD, and resistors R1, R2, R3, and R4.

Control signal(s) IN may be output from the controller 200 to control the turn-on/turn-off state of the transistor Xs. In embodiments of the invention, the control signal IN may have a high voltage Vcc, i.e., a relatively high level voltage that is greater than a threshold voltage of the transistor Xs, or 0V, i.e., a low voltage. The control signal(s) IN may have a high voltage, e.g., Vcc, when the transistor Xs is to be turned on, and the control signal(s) IN may have a low voltage, e.g., 0V, when the transistor Xs is to be turned off. The control signal(s) IN may be supplied from the controller 200. A voltage, e.g., operating voltage, supplied to and/or employed by the controller 200 may be less than the voltage(s), e.g., Vcc, employed for driving the transistor Xs. An amplifier (not shown) may be used to amplify the control signal IN, from the controller 200, in order to supply, e.g., the voltage Vcc for driving the transistor Xs and/or compensate for, e.g., the lower operating voltage of the controller 200. Thus, e.g., the turn-on/turn-off state of the transistor Xs may be controlled by the controller 200 and an amplifier.

Referring to FIG. 3, the NPN transistor $X_1$ and the PNP transistor $X_2$ may form a push-pull circuit 121*a*. Bases B and B' of the NPN transistor $X_1$ and the PNP transistor $X_2$ may be connected to each other. The control signal IN may be input to the NPN transistor X, and the PNP transistor $X_2$, and the NPN transistor X, and the PNP transistor $X_2$ may output the high voltage Vcc or the low voltage 0V in response to the control signal IN received.

In embodiments of the invention, an input terminal, e.g., a collector C of the NPN transistor $X_1$, of a high level power source of the push-pull circuit 121*a* may be coupled to the power source Vcc for supplying the high voltage Vcc, and an input terminal, e.g., a collector C' of the PNP transistor $X_2$, of a low level power source of the push-pull circuit 121*a* may be coupled to the ground power source. The resistor R1 may be coupled between an emitter E of the NPN transistor $X_1$ and an output terminal OUT of the push-pull circuit 121*a*, and an emitter E' of the PNP transistor $X_2$ may be coupled to the output terminal OUT of the push-pull circuit 121*a*.

The capacitor C1 may be coupled between the output terminal OUT of the push-pull circuit 121*a* and the gate of the transistor Xs. The resistor R2 may be coupled between a first terminal of the capacitor C1 and a ground power source, and the resistor R3 may be coupled between a second terminal of the capacitor C1 and a source of the transistor Xs. The capacitor C1 may be charged with a source voltage of the transistor Xs through a path of the resistor R3, the capacitor C1, the resistor R2, and the ground power source when the low voltage 0V is output from the output terminal OUT of the push-pull circuit.

The resistor R4 may be coupled between the gate of the transistor Xs and the second terminal of the capacitor C1. The resistors R2, R3, and R4 may be formed to prevent an abrupt voltage variation of the capacitor C1. The zener diode ZD may be coupled between the gate and source of the transistor Xs to maintain a constant voltage difference therebetween.

Next, an exemplary operation of the gate driving circuit of FIG. 3 will be described.

When the control signal IN corresponds to the high voltage Vcc, the PNP transistor $X_2$ may be turned off, and the NPN transistor $X_1$ may be turned on. A parasitic capacitor between the gate and source of the transistor Xs may be charged through the path of the power source Vcc, the transistor $X_1$, the resistor R1, the capacitor C1, the resistor R4, and the transistor Xs. When the capacitor C1 is charged with the source voltage Vs, the gate voltage of the transistor Xs may be increased to a voltage Vcc+Va corresponding to a sum of the voltages Vcc and Va. The gate-source voltage of the transistor Xs may become the voltage Vcc, and accordingly the transistor Xs may be turned on.

When the control signal IN corresponds to the low voltage 0V, the NPN transistor $X_1$ may be turned off and the PNP transistor $X_2$ may be turned on. Then, the parasitic capacitor between the gate and source of the transistor Xs may be discharged through a path of the transistor Xs, the resistor R4, the capacitor C1, the transistor $X_2$, and the ground power source. The gate voltage of the transistor Xs may be decreased to the voltage Vs by the charging voltage of the capacitor C1. The gate-source voltage of the transistor Xs may become 0V, and accordingly, the transistor Xs may be turned off.

When the control signal IN is changed from the low voltage 0V to the high voltage Vcc, e.g., when the PNP transistor $X_2$ is turned off and the NPN transistor $X_1$ is turned on, there may be a time delay corresponding to a time for the voltage of the output terminal OUT of the push-pull circuit 121*a* to be changed by the resistor R1 from the voltage 0V to the voltage Vcc. The time delay may correspond to a time constant associated with a time taken by the parasitic capacitor between the gate and source of the transistor Xs to be charged with the source voltage Vs via the current supplied by the power source Vcc through the path of the power source Vcc, the transistor X1, the resistor R1, the capacitor C1, the resistor R4, and the transistor Xs. The time constant may be determined by characteristics of the resistor R1 and the parasitic capacitor of the transistor Xs. A time period for changing the gate-source voltage of the transistor Xs from the low voltage 0V to the high voltage Vcc may be longer than that for changing the gate-source voltage of the transistor Xs from the high voltage Vcc to the low voltage 0V.

In FIG. 2, in the case that the control signal(s) IN corresponding to a voltage level for turning-off the transistor Xs and turning-on the transistor Xg is/are input, if a starting point for turning-off the transistor Xs is slower than and/or occurs after a starting point for turning-on the transistor Xg, the transistors Xs and Xg may be simultaneously in a turned-on state, and an undesirable short circuit may result. Embodiments of the invention, provide a driving circuit for driving a gate of a transistor such that the start pointing for turning-off of the transistor Xs is faster than and/or occurs prior to a starting point for turning-on the other transistor(s), e.g., transistor Xg of the sustain voltage supply 120. Embodiments of the invention provide a driving circuit capable of controllably driving a gate of a transistor of a display device in a manner that prevents and/or reduces undesirable short circuits that may occur during switching of control signals IN for switching respective states of transistors, e.g., Xs, Xg, between on and/or off states.

In the exemplary embodiment illustrated in FIG. 3, bipolar junction transistors (BJT) are illustrated, as exemplary embodiments of the transistors $X_1$ and $X_2$. In general, a bipolar junction transistor may have a limited boundary voltage Vebo allowable between the base B and emitter E thereof in a turned-off state. Accordingly, in the case that the control signal IN has the high voltage Vcc, because the voltage of the output terminal OUT is not abruptly changed by the resistor R1 on the charging of the parasitic capacitor, the voltage Veb between the base B and emitter E of the transistor $X_2$ may exceed the boundary voltage Vebo, and accordingly, the transistor $X_2$ may be damaged.

Figure 4:
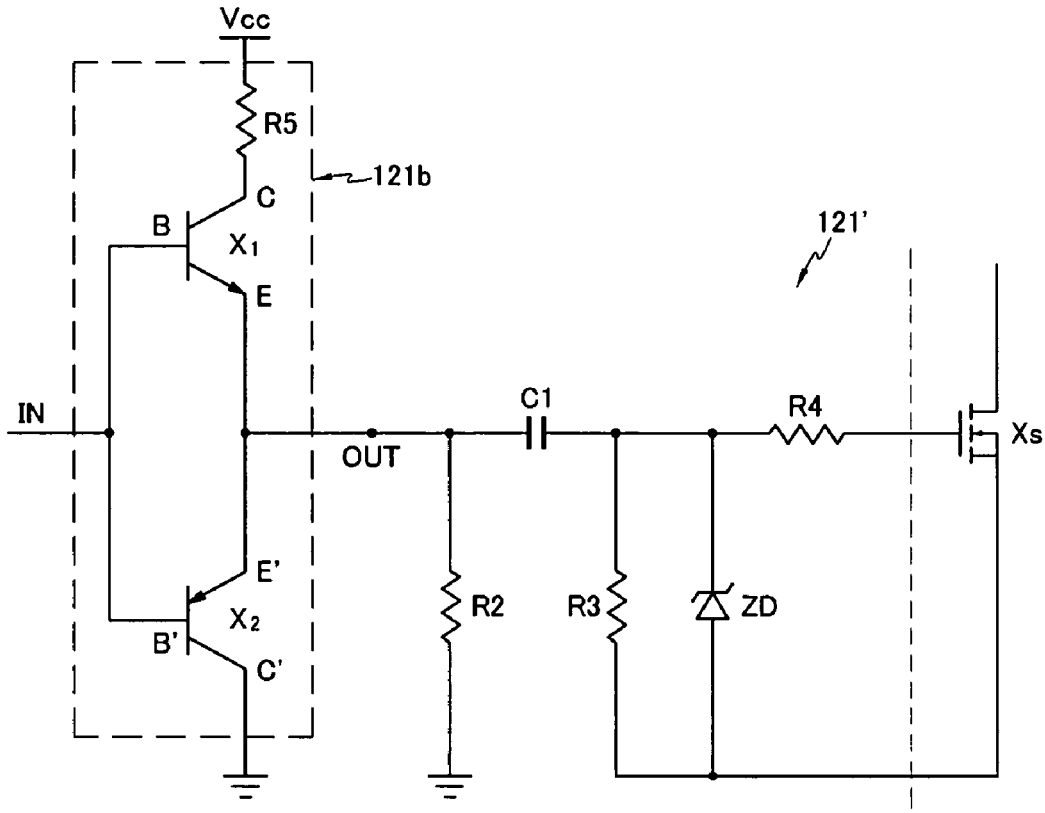
FIG. 4 illustrates a second exemplary embodiment of a gate driving circuit employing one or more aspects of the present invention.
Figure 5:
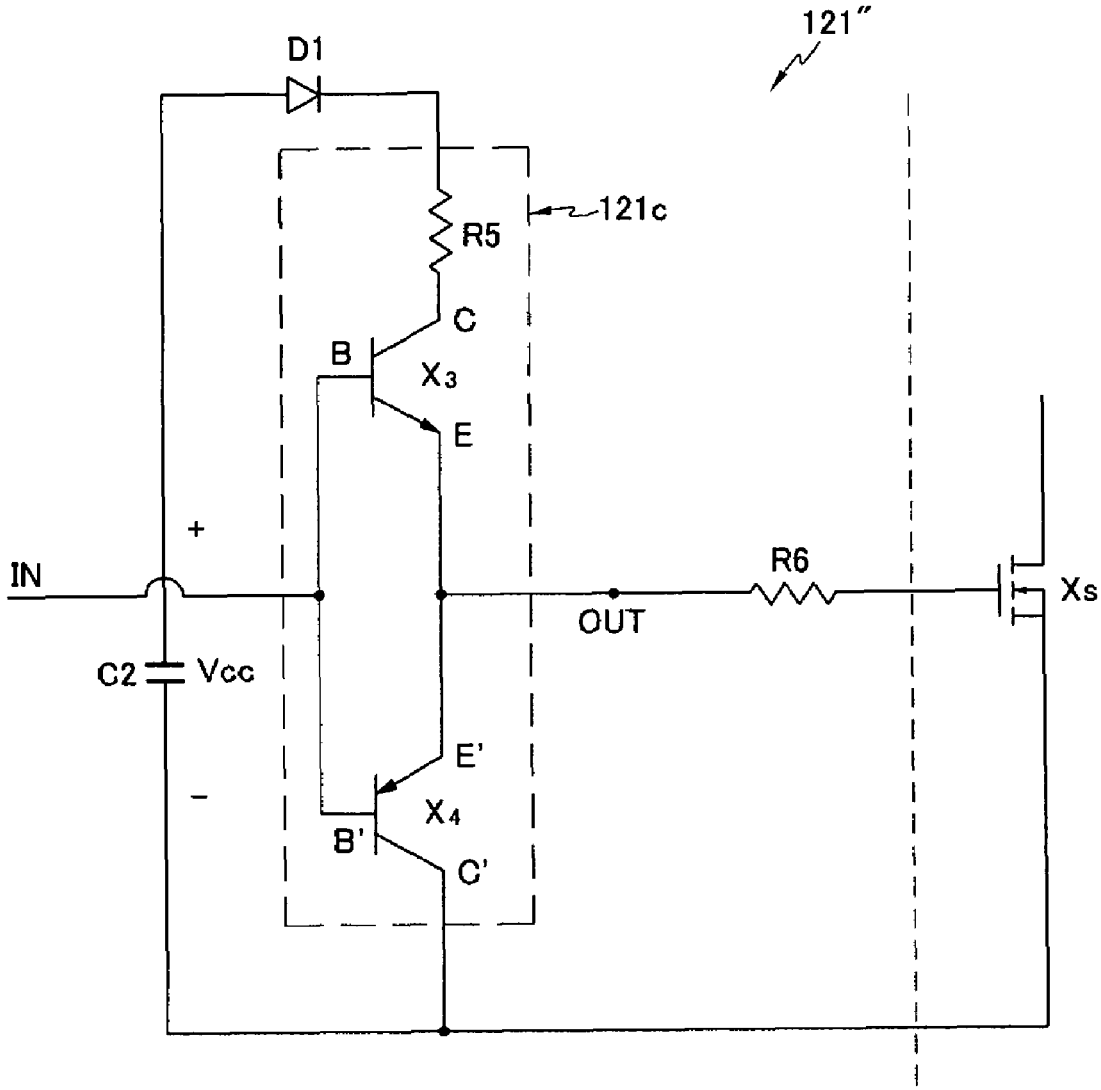
FIG. 5 illustrates a third exemplary embodiment of a gate driving circuit employing one or more aspects of the present invention.

FIGS. 4 and 5 illustrate second and third exemplary embodiments of a gate driving circuit while preventing damage to the transistor $X_2$ of the first exemplary embodiment illustrated in FIG. 3.

As illustrated in FIG. 4, a gate driver 121' according to the second exemplary embodiment may have the same structure as the gate driving circuit of the FIG. 3, but for a resistor R5 instead of the resistor R1. As illustrated in FIG. 4, in the second exemplary embodiment of the invention, the resistor R5 of a push-pull circuit 121*b* may be coupled between the power source Vcc and the collector C of the NPN transistor $X_1$.

In the same manner as described in relation to the exemplary embodiment illustrated in FIG. 3, when the control signal IN corresponds to the high voltage Vcc, the PNP transistor $X_2$ may be turned off and the NPN transistor $X_1$ may be turned on, and current may flow from the NPN transistor $X_1$ to the gate of the transistor Xs.

Similar to the exemplary embodiment illustrated in FIG. 3, in this exemplary embodiment, because the resistor R5 is coupled to the collector C of the NPN transistor $X_1$, a charging speed of the parasitic capacitor of the transistor Xs may be slowed.

When the control signal IN has the high voltage Vcc, the voltage of the output terminal OUT of the push-pull circuit 121*b* may have a voltage Vcc-Vth corresponding to a difference voltage between the voltage Vcc of the base B of the NPN transistor $X_1$ and the threshold voltage Vth of the transistor $X_1$. The voltage between the base B' and the emitter E' of the turned-off PNP transistor $X_2$ may become the voltage Vth. Accordingly, since the threshold voltage Vth is smaller than the boundary voltage Vebo, the transistor $X_2$ may not be damaged.

In the exemplary embodiment illustrated in FIG. 4, only the collector C of the NPN transistor $X_1$ is coupled to the resistor R5, i.e., the emitter E' of the PNP transistor $X_2$ is not coupled to the resistor R5. However, another resistor may be coupled between the collector C' of the PNP transistor $X_2$ and the ground power source. In such embodiments, when the resistor R5 coupled to the collector C of the NPN transistor $X_1$ may be set to have a resistance greater than that of a resistor coupled to the collector C' of the PNP transistor $X_2$, the turn-off speed of the transistor Xs may be faster than the turn-on speed.

Referring to FIG. 5, a gate driver 121" according to the third exemplary embodiment may include a NPN transistor $X_3$, a PNP transistor $X_4$, a capacitor C2, a diode D1, and resistors R5 and R6. The NPN transistor $X_3$ and the PNP transistor $X_4$ may form a push-pull circuit 121*c*. The resistor R5 may be coupled to the collector C of the NPN transistor $X_3$ in the same manner as the second exemplary embodiment illustrated in FIG. 4. The resistor R6 may be coupled between the output terminal OUT of the push-pull transistor and the gate of the transistor Xs so as to prevent an abrupt voltage variation therebetween.

A first terminal of the capacitor C2 may be coupled to a collector C of the NPN transistor $X_3$ through the resistor R5, and a second terminal may be coupled to a collector C' of the PNP transistor $X_4$.

The capacitor C2 may be charged with the voltage Vcc. The second terminal of the capacitor C2 and the collector C' of the PNP transistor $X_4$ may be coupled to the source of the transistor Xs. According to the push-pull circuit 121*c*, a voltage applied to a high level power input terminal, i.e., the collector C of the NPN transistor $X_3$, may have a voltage Vcc+Va that is greater than the voltage Vcc by the voltage Va applied to a low level power input terminal, i.e., the collector C' of the PNP transistor $X_4$. In addition, the diode D1 may be coupled between the capacitor C2 and the collector C of the NPN transistor $X_3$ such that the current flows along one direction.

Next, an operation of the gate driving circuit of FIG. 5 will be described.

When the control signal IN becomes the voltage Vcc+Va, the PNP transistor $X_4$ may be turned off and the NPN transistor $X_3$ may be turned on, and accordingly, current may flow from the NPN transistor $X_3$ to the gate of the transistor Xs. In addition, when the control signal IN becomes the voltage Va, the PNP transistor $X_4$ may be turned on and the NPN transistor $X_3$ may be turned off, and accordingly, the gate-source voltage of the transistor Xs may become the low voltage 0V so that the transistor Xs may be turned off.

When the control signal IN is changed from the voltage Va to the voltage Vcc+Va, that is, the PNP transistor $X_4$ is turned off and the NPN transistor $X_3$ is turned on, the charging speed of the parasitic capacitor of the transistor Xs may be slowed because the resistor R5 is coupled to the collector C of the transistor $X_3$ in the same manner as the first and second exemplary embodiments illustrated in FIGS. 3 and 4.

In addition, when the control signal IN corresponds to the voltage Vcc+Va, the voltage of the output terminal OUT of the push-pull circuit 121*c* becomes the voltage Vcc+Va-Vth, which is reduced by the threshold voltage Vth of the transistor $X_3$ from the voltage Vcc+Va in the same manner as the second exemplary embodiment. That is, the threshold voltage Vth between the base B' and emitter E' of the turn-off PNP transistor $X_4$ is less than the boundary voltage Vebo, and accordingly, the transistor $X_4$ may not be damaged.

According to the second and third exemplary embodiments of the present invention, because the push-pull circuit 121*b*, 121*c* includes a resistor coupled to the collector of the NPN transistor, a speed for turning on the transistor Xs may be slowed, and the PNP transistor may be protected as well. If the push-pull circuit 121*b*, 121*c* has a resistor coupled to the collector C' of the transistor $X_2$, $X_4$, another gate driving circuit rather than the gate driving circuit of the present exemplary embodiment may be used.

According to an exemplary embodiment of the present invention, referring to FIG. 2, it has been described that the sustain pulse of the voltage Vs is alternately applied to the Y and X electrodes. However, a gate driving circuit according to an exemplary embodiment of the present invention can be applied to any driving circuit including the push-pull transistor in the gate driver.

A transistor including the push-pull circuit in the gate driver according to an exemplary embodiment of the present invention can prevent the overlapping of signals applied thereto by reducing the turn-on speed of a transistor by providing a resistor coupled to the push-pull circuit. When a resistor is coupled to the input terminal of a high level power source of the push-pull circuit, transistor elements for the push-pull circuit can be protected.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A flat display device, comprising a plurality of electrodes arranged in one direction;

a first transistor coupled between the plurality of electrodes and a first power source for supplying a first voltage; and a gate driving circuit for supplying a driving voltage to a gate of the first transistor through a push-pull circuit including second and third transistors coupled between second and third power sources for respectively supplying second and third power voltages;

wherein a resistance between the second transistor and the second power source is greater than that between the third transistor and the third power source.

2. The flat display device as claimed in claim 1, wherein one of the second and third transistors is an NPN transistor and the other of the second and third transistors is a PNP transistor.

3. The flat display device as claimed in claim 1, further comprising a first resistor between the second power source and a collector of the second transistor.

4. The flat display device as claimed in claim 1, wherein a time for changing a voltage between the gate and a source of the first transistor from a fourth voltage corresponding to the third voltage to a fifth voltage corresponding to the second voltage in response to a turn-on of the second transistor is longer than that for changing a voltage between the gate and source of the first transistor from the fifth voltage to the fourth voltage corresponding to the second voltage in response to a turn-on of the third transistor.

5. The flat display device as claimed in claim 2, wherein a control signal having a first voltage level or a second voltage level is applied to bases of the second and third transistors;

the second transistor is turned on in response to a first voltage level of the control signal, and the third transistor is turned on in response to a second voltage level of the control signal, the first voltage level being different from the second voltage level; and emitters of the second and third transistors are coupled to an output terminal of the push-pull circuit.

6. The flat display device as claimed in claim 5, wherein the second transistor is the NPN transistor, the third transistor is the PNP transistor, and the first voltage level is greater than the second voltage level.

7. The flat display device as claimed in claim 5, further comprising a capacitor coupled between the output terminal of the push-pull circuit and the gate and source of the first transistor.

8. The flat display device as claimed in claim 7, further comprising:

a second resistor coupled between the first power source and a first terminal of the capacitor;

a third resistor coupled between a second terminal of the capacitor and the gate of the first transistor;

a fourth resistor coupled between the second terminal of the capacitor and a source of the first transistor; and a zener diode coupled between the second terminal of the capacitor and the source of the first transistor.

9. The flat display device as claimed in claim 5, further comprising a capacitor having a first terminal for supplying the second voltage of the second power source and a second terminal for supplying the third voltage of the third power source, and charged with a voltage corresponding to a difference between the second and third voltages, the second terminal being coupled to the source of the first transistor.

10. The flat display device as claimed in claim 9, further comprising a diode coupled between the first terminal of the capacitor and the first resistor.

11. The flat display device as claimed in claim 10, further comprising a second resistor coupled between the gate of the first transistor and the output terminal of the push-pull circuit.

12. A gate driving device for driving a gate of a driving transistor, the gate driving device comprising:

a first transistor having an emitter coupled to an output terminal of the gate driving device;

a first resistor coupled between a first power source for supplying a first voltage and a collector of the first transistor;

a second transistor of a different conductive type from the first transistor, having an emitter coupled to the output terminal and a collector coupled to a second power source for supplying a second voltage; and a second resistor coupled between the collector of the second transistor and the second power source, wherein a resistance of the first resistor is greater than a resistance of the second resistor, and wherein a gate of the driving transistor is applied with a voltage corresponding to a voltage of the output terminal in response to a control signal applied to bases of the first and second transistors.

13. The gate driving apparatus as claimed in claim 12, wherein the control signal has a first voltage level or a second voltage level, the first transistor is turned on in response to the first voltage level, and the second transistor is turned on in response to the second voltage level, the first voltage level being different from the second voltage level.

14. The gate driving apparatus as claimed in claim 13, further comprising a capacitor coupled between the output terminal and the gate of the driving transistor.

15. The gate driving apparatus as claimed in claim 13, further comprising a capacitor having a first terminal for supplying a first voltage of the first power source and a second terminal for supplying a second voltage of the second power source, and charged by a voltage corresponding to a difference between the first and second voltages, the second terminal being coupled to a source of the first transistor.

16. The gate driving apparatus as claimed in claim 13, wherein the first transistor is a NPN transistor and the second transistor is a PNP transistor.

17. A driving circuit for a flat panel display apparatus including a plurality of electrodes arranged in one direction, a first transistor coupled between the plurality of electrodes and a first power source for supplying a first voltage, the driving circuit for driving the first transistor, the driving circuit comprising:

a push-pull circuit including second and third transistors coupled between second and third power sources for respectively supplying second and third power sources; and delaying means for delaying a start time for supplying a turn-on voltage signal for turning on the first transistor relative to a start time for supplying a turn-off signal for turning off the first transistor.

18. The driving circuit as claimed in claim 17, wherein the delaying means includes resistance means between at least one of the second transistor and the second power source and the third transistor and the third power source such that a resistance between the second transistor and the second power source is greater than a resistance between the third transistor and the third power source.

19. The driving circuit as claimed in claim 17, wherein the second and third transistors are coupled at an output terminal of the push-pull circuit, and the delaying means includes resistance means between the output terminal of the push-pull circuit and the second transistor.

* * * * *